United States Patent [19]

Shiga et al.

[11] 4,218,505

[45] Aug. 19, 1980

[54] PRODUCTION OF POLYURETHANE-SPLIT LEATHER LAMINATE

[75] Inventors: Yasuhiro Shiga; Yoshikazu Hida, both of Osaka, Japan

[73] Assignee: Toyo Cloth Co., Ltd., Sennan, Japan

[21] Appl. No.: 781,528

[22] Filed: Mar. 25, 1977

[30] Foreign Application Priority Data

Apr. 1, 1976 [JP] Japan ..... 51-36779
Nov. 2, 1976 [JP] Japan ..... 51-132064

[51] Int. Cl.[2] ..... B32B 3/26; B32B 5/20; B32B 9/02

[52] U.S. Cl. ..... 428/306; 428/315; 428/423.3; 428/473; 428/904; 428/423.5

[58] Field of Search ..... 428/91, 96, 310, 315, 428/473, 904, 304, 306, 308, 424, 425, 151

[56] References Cited

U.S. PATENT DOCUMENTS

| | | | |
|---|---|---|---|
| 3,462,326 | 8/1969 | Steel et al. | 156/209 |
| 3,549,475 | 12/1970 | Hefley et al. | 428/293 |
| 3,553,008 | 1/1971 | Reischl et al. | 428/310 |
| 3,597,297 | 8/1971 | Buchholtz et al. | 428/311 |
| 3,650,880 | 3/1972 | Tieniber | 428/311 |
| 3,713,938 | 1/1973 | Sutton | 428/423 |
| 3,794,548 | 2/1974 | Wirth et al. | 428/91 |
| 3,827,930 | 8/1974 | Sutton | 428/906 |
| 3,847,720 | 11/1974 | Laberinti | 428/305 |
| 3,941,633 | 3/1976 | Wang et al. | 428/311 |

FOREIGN PATENT DOCUMENTS 1306372 2/1973 United Kingdom .

*Primary Examiner*—William J. Van Balen
*Attorney, Agent, or Firm*—Haight & Huard

[57] ABSTRACT

A polyurethane top coating and a porous, polyurethane interposing layer are formed on a release carrier sheet. Split leather hide is bonded onto the porous layer with a compatible adhesive and the release carrier sheet is stripped from the top coat. The resultant laminate has the appearance and other properties of top-grain leather. The interposing porous layer functions as a cushion and prevents uneven deformation of top coat when the laminate is folded or stretched.

2 Claims, 1 Drawing Figure

PRODUCTION OF POLYURETHANE-SPLIT LEATHER LAMINATE

Figure 1:
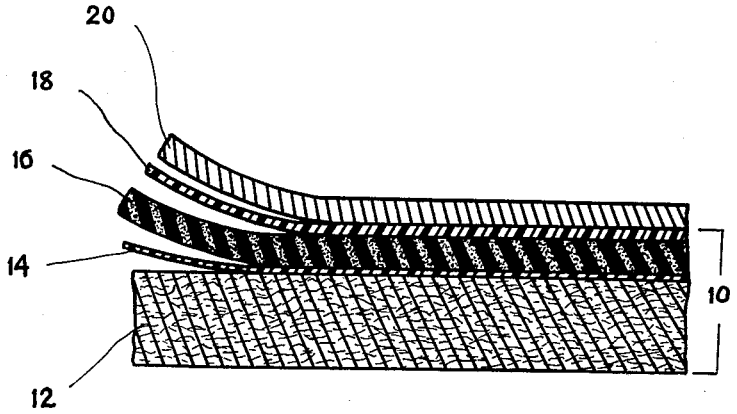

This invention relates to the production of laminates comprising a polyurethane top coating, a porous intermediate layer and split leather substrate. The resultant laminate has the appearance and other properties of top-grain leather.

Split leather is the cellular portion of a leather hide which remains after removal of top-grain veneer from the leather hide. The top-grain leather finds a variety of uses in the production of various secondary articles such as shoes, bags, gloves, clothings and the like. Split leather has found only limited uses as such. It has been proposed by the U.S. Pat. No. 3,827,930 to provide a split leather/polyurethane film laminate which has the appearance and other properties of top-grain leather.

It has been found that such a product is not satisfactory in that the surface top coat is rendered uneven when it is folded or bent so that the top surface is strongly stretched as is often encountered in the production of shoes, bags or the like. In the prior art laminate a pre-cast, fully reacted polyurethane film is bonded to one surface of a substrate of split leather by a discontinuous tie-coat of a compatible adhesive material. Since split leather has a cellular structure formed by collagen fibrils, the polyurethane film and the split leather are bonded together only at the points of contact of said fibrils on a flat surface of the film. When the laminate is stretched laterally, the entire structure reduces in thickness in areas where the fibrils have not been rigidly bonded to the film more than in the other areas. This uneven reduction in thickness renders the top surface rough, resulting in a number of recesses on the top surface.

Accordingly, it is an object of the present invention to provide a laminate of split leather having a polyurethane finish coat thereon which is free from the above-mentioned defect.

Another object of the present invention is to provide a semi-synthetic leather whose appearance and other properties are very similar to those of natural top-grain leather.

Still another object of this invention is to provide a process for producing the above-described laminate by a transfer method.

Other and further objects thereof will be apparent from the following detailed description and claims, and the accompanying drawing. The FIGURE is a schematic, cross-sectional view of a portion of a product according to this invention prior to removal of the release paper therefrom.

According to the present invention, the foregoing objects can be accomplished by forming an interposing a porous polyurethane layer between the polyurethane top layer corresponding to top-grain leather and the split leather substrate. The porous polyurethane interposing layer functions as a cushion and thus prevents uneven reductions in thickness of the top film when the laminate is folded or stretched.

In a preferred embodiment of this invention, a solution of polyurethane elastomer is cast on a carrier sheet such as release papers, polyethyleneterephthalate films or metallic belts and the film is dried to remove solvent therefrom. The polyurethane elastomer may preferbly be any of the polyester, polyether, polyester-ether and polyester-amide type or mixtures thereof. The polyurethane elastomer preferably has an average molecular weight from 20,000 to 100,000 and is dissolved in a solvent thereof such as dimethylformamide, dimethylsulfoxide, tetrahydrofuran, or dioxane, or in a mixture of the solvent with a diluent such as methyl ethyl ketone, ethyl acetate, acetone, 2-methoxyethanol or 2-ethoxyethanol, to a concentration from 6 to 50% by weight. The ratio of solvent to diluent is preferably from 1:0 to 1:2. The solution may contain a coloring matter such as dye or pigment.

The casting may be performed in a conventional manner such as spreading, extruding or by means of a knife or roll coater.

The amount of polyurethane elastomer to be cast is preferably from 7 to 50 g./m$^2$ on a dry weight basis. After casting, the film may be dried in a conventional manner such as infrared lamp, steam or hot air blast drying at a temperature from 70° to 150° C. for from 0.5 to 30 minutes to give a top finish after removal of the carrier sheet therefrom.

A second porous layer may be formed on the top layer in an overlaying relation thereto by casting a composition to be used for the production of polyurethane foam. Such foaming compositions are well-known in the art and contain unreacted terminal isocyanate groups which generate carbon dioxide gas upon exposure to moist air. A suitable composition contains urethane prepolymers having terminal isocyanate groups. The prepolymers may be of the polyester, polyether, polyesterether or polyester-amide type, and preferably have an average molecular weight from 1,500 to 25,000. The foaming composition may be prepared by dissolving the prepolymer in a solvent such as methyl ethyl ketone, ethyl acetate, toluene, methylene chloride, dioxane or dimethylformamide to a concentration from 40 to 95% by weight and adding an amine catalyst and, if necessary, a coloring matter to the solution. This foaming composition may be cast on the layer of polyurethane top film in a conventional manner in an amount from 50 to 200 g./m$^2$ on a dry weight basis.

Alternatively, the porous interposing layer may be formed by using a composition containing a polyisocyanate compound such as toluylenediiscyanate, hexamethylenediisocyanate, diphenylmethanediisocyanate or an addition-product of 1 mole of glycerol and 3 moles of toluylenediisocyanate, and a polyether diol. The diol must have terminal active hydrogen atoms and preferably has an average molecular weight from 2,000 to 25,000. The mixture of polyisocyanate and diol is dissolved in a solvent such as dimethylformamide, dimethylacetamide, dioxane, methyl ethyl ketone, ethyl acetate, toluene or benzene to a concentration from 10 to 50% by weight.

To the solution is added a filler having a bulk density from 0.1 to 0.5 g./ml and an average particle size from 15 to 80 microns. Examples of such fillers include organic materials such as pulverized cellulose pulp and inorganic materials such as zeolite, "Shirasu Glass Micro Balloon" or zieclite.

The amount of filler to be added is preferably from 10 to 50 parts by weight per 100 parts by weight of the resin content. The composition may also contain a coloring matter, if necessary. This type of composition is applied preferably in an amount from 25 to 150 g./m$^2$ on a dry weight basis in a conventional manner as above. It is also possible to mix the above-described foaming composition with the above-described filler.

After casting, the second layer is dried in a conventional manner as above at a temperature from 60 to 135° C. for from 0.5 to 30 minutes. A cellular structure is formed during the drying step which increases in thickness in from about 1.2 to 3.0 times by the generation of carbon dioxide by the reaction of isocyanate groups with water present in the atmosphere.

When filler is present, the cellular structure develops about individual particles of the filler. Split leather substrate may be laminated onto the porous polyurethane layer with a compatible adhesive. The adhesive may be of the same composition as the porous layer. A suitable adhesive composition is a solution of a mixture of a polymeric diol or polymeric diamine of an average molecular weight of 1,500 to 23,000 having terminal hydrogen atoms with a polyisocyanate compound such as diisocyanates or triisocyanates.

Another suitable adhesive is a solution of a mixture of an urethane prepolymer of the polyester, polyether, polyesterether or polyester-amide type having an average molecular weight from 2,500 to 25,000 and terminal isocyanate groups in the molecule with a diol or triol having terminal hydrogen atoms and an average molecular weight from 300 to 4,000.

The above mixture is dissolved in a solvent such as toluene, benzene, methyl ethyl ketone, ethyl acetate or dioxane to a concentration from 25 to 90% by weight. The adhesive may be applied onto either the porous polyurethane layer or one surface of split leather in an amount from 30 to 150 g./m$^2$ based on the solid content by conventional means such as knife coater, roller coater or extruder. The split leather substrate is then laid onto the wet adhesive layer. The entire assembly is then nipped or pressed, if necessary, and dried at a temperature from 60 to 130° C. for from 0.1 to 20 minutes.

The release carrier sheet is then removed by stripping from the polyurethane top surface to form the finished product.

Referring to the figure, a portion of the final product 10 thus obtained is shown in cross-section prior to removal of release carrier sheet 20. A split leather substrate 12 is overlaid by an adhesive layer 14, which is, in turn, overlaid by a porous polyurethane layer 16. The porous polyurethane layer is, in turn, overlaid by a polyurethane top coat 18. Since porous polyurethane layer 16 can accomodate to deformation of the split leather substrate 12, the entire laminate can be folded or bent without rendering the surface of top coat 18 uneven.

Without further elaboration, it is believed that one skilled in the art can, using the preceding description, utilize the present invention to its fullest extent. The following preferred specific embodiments are, therefore, to be construed as merely illustrative, and not limitative of the reminder of the disclosure in any way whatsoever.

All parts and % in the examples are by weight unless otherwise indicated.

EXAMPLE 1

100 parts of polyurethane elastomer sold under the trade name "HI-LAC 6131" from Toyo Polymer Co., Ltd., Japan and 10 parts of pigment were dissolved in 435 parts of dimethylformamide. The solution was cast onto a commercial release paper at a rate of 23 g./m$^2$ based on the solid content.

The paper was dried at 140° C. to give a top coat corresponding to top-grain layer.

Onto the dried top coat was applied a foaming composition consisting of 80 parts of an isocyanate terminated urethane prepolymer sold under the trade name "NIPPORAN" from Nippon Polyurethane Kogyo Co., Ltd., Japan, 2 parts of trimethylenediamine and 10 parts of methylene chloride at a rate of 96 g./m$^2$ based on the solid content. The foaming composition was dried and permitted to foam to twice its thickness at 100° C.

An adhesive composition consisting of 60 parts of a hydroxyl terminated urethane sold under the trade name "HI-LAC TATX" from Toyo Polymer Co., Ltd., Japan, 10.5 parts of toluene was applied on the porous polyurethane layer at a rate of 90 g./m$^2$ based on the solid content.

Split leather hide which had been buffed on one surface was laid onto the wet adhesive layer. The entire assembly was heated at 120° C. to dry the adhesive layer and the release paper was stripped from the assembly to give the finished product.

EXAMPLE 2

100 parts of polyurethane elstomer sold under the trade name "KRESBON 6666" from Dainippon Ink and Chemicals Inc., Japan, 10 parts of pigment and 1 part of dye were dissolved in a mixture of 120 parts of dimethylformamide and 320 parts of methyl ethyl ketone. The solution was cast onto a polyethyleneterephthalate release sheet at a rate of 21 g./m$^2$ based on the solid content. The paper was dried at 90° C. to give a top coat corresponding to top-grain layer.

100 parts of a hydroxyl terminate urethane prepolymer sold under the trade name "HI-LAC TATX" from Toyo Polymer Co., Ltd., Japan and 11 parts of isophoronediisocyanate were dissolved in a mixture of 40 parts of dimethylformamide, 30 parts of methyl ethyl ketone and 40 parts of toluene.

To the solution were added 18 parts of pulverized cellulose pulp having an average particle size of 25 microns and a bulk density of 0.30 g./ml, and 3 parts of pigment. The resulting composition was applied onto the dried top coat at a rate of 90 g./m$^2$ based on the solid content and dried at 115° C. to form a porous polyurethane layer.

An adhesive composition was prepared by dissolving 100 parts of a hydroxyl terminated urethane prepolymer sold under the trade name "RESAMIN UD 660 HV" from Dainichiseika Colour & Chemicals Mfg. Co., Ltd., Japan and 10 parts of toluylendiisocyanate in a mixture of 30 parts of dimethylformamide, 30 parts of methyl ethyl ketone and 40 parts of toluene.

The adhesive composition was applied on the porous polyurethane layer at a rate of 70 g./m$^2$. Split leather hide which had been buffed on one surface was laid onto the wet adhesive layer with a slight pressure. The entire assembly was dried at 120° C. and the release sheet was stripped from the assembly to give the finished product.

EXAMPLE 3

Example 1 was repeated except that the foaming composition contained 15 parts of "Shirasu Glass Micro Balloon" (hollow glass microballoons made from weathered lava sand) having an average particle size of 40 microns and a bulk density of 0.21 g/ml, 5 parts of dimethylformamide and 55 parts of methylene chloride in addition to the urethane prepolymer and the amine catalyst.

EXAMPLE 4

Example 2 was repeated except that the adhesive composition was applied onto the buffed surface of split leather hide rather than the porous polyurethane layer.

CONTROL A

A laminated product was produced by repeating Example 1 with the exception that the porous polyurethane layer was omitted.

CONTROL B

Example 1 was repeated except that the split leather hide was replaced by a synthetic suede leather which had been made by impregnating nonwoven baric with an polyurethane elastomer.

CONTROL C

Example 2 was repeated except that 18 parts of talc having an average particle size of 8 microns and a bulk density 0.7 g./ml were used instead of the pulverized cellulose pulp.

CONTROL D

Example 2 was repeated except that the adhesive composition was omitted.

The resulting products are tested in some of their important properties and the results obtained therefrom are shown in the following tables.

Table 1

| Product | Flatness | Flex resistance, times at −5° C. | Crumpling resistance, times/kg. | Abrasion resistance, times | Hardness, mg. | Scratch resistance, g/mm$^2$ |
|---|---|---|---|---|---|---|
| EX. 1 | unchanged | $6.0 \times 10^4$ | $5.5 \times 10^3$ | 1100 | 672 | 600 |
| EX. 2 | unchanged | $9.0 \times 10^4$ | $5.5 \times 10^3$ | 1400 | 551 | 900 |
| EX. 3 | unchanged | $8.0 \times 10^4$ | $5.0 \times 10^3$ | 1200 | 570 | 700 |
| EX. 4 | unchanged | $9.5 \times 10^4$ | $5.5 \times 10^3$ | 130 | 545 | 900 |
| Control A | changed | $5.5 \times 10^4$ | $5.0 \times 10^3$ | 1100 | 607 | 700 |
| Control B | changed | $6.0 \times 10^4$ | $5.0 \times 10^3$ | 900 | 3300 | 400 |
| Control C | little | $5.0 \times 10^4$ | $3.0 \times 10^3$ | 650 | 400 | 500 |
| Control D | little | $4.5 \times 10^4$ | $2.5 \times 10^3$ | 1300 | 1150 | 800 |
| Top-grain leather | unchanged | $19.0 \times 10^4$ | $8.0 \times 10^3$ | 2000 | 1230 | 1300 |

Table 2

| Product | Moisture permeability g/cm$^2$/24 hrs. RH 90% | Moisture retaining rate, mg/cm$^3$ | Moisture discharging rate, mg/cm$^3$ |
|---|---|---|---|
| EX. 1 | 1400 | 43 | 22 |
| EX. 2 | 1250 | 45 | 23 |
| EX. 3 | 800 | 41 | 20 |
| EX. 4 | 1000 | 44 | 23 |
| Control A | 1250 | 42 | 21 |
| Control B | 700 | 13 | 7 |
| Control C | 840 | 38 | 19 |
| Control D | 1300 | 43 | 20 |
| Top-grain leather | 1850 | 47 | 24 |

In the above test, crumpling resistance, hardness and moisture permeability were determined in accordance with the applicable JIS test methods, e.g. K-6772, L-1079 and Z-0208 respectively.

Flatness was judged visually by the regularity of top surface when the test piece was folded with the top coating facing outwardly.

Flex resistance was determined by subjecting the test piece to a flex-fatigue tester at −5° C. and folding the piece at 200 times/min. until cracks developed on the top coating layer.

Abrasion resistance was determined by forcing the test piece against a rotating canvas drum while loading a pressure of 0.5 kg/3 mm$^2$ until the top coating was destroyed.

Scratch resistance was determined by subjecting the test piece to a Clemense scratch tester and travelling 1 mm$^2$ point for a length of 4.5 cm on the test piece with varying load until a scratch was formed.

Moisture retaining rates and moisture discharging rate were determined by the increase or decrease in weight of the test piece which had been humidified for 24 hours at 20° C. and 45% RH or at 40° C. and 90% RH when the test piece was exposed for 3 hours at 40° C. and 90% RH or vice versa.

As the above data show, the product of the present invention has the properties of top-grain leather and keeps a regular surface structure when folded or stretched.

Accordingly, the product can be utilized in any application where conventionally finished top-grain leather has been used heretofore.

From the foregoing description, one skilled in the art can easily ascertain the essential characteristics of this invention and, without departing from the spirit and scope thereof, can make various changes and modifications of this invention to adapt it to various usages and conditions.

What is claimed is:

1. A polyurethane-split leather laminate comprising:
   (a) a split leather hide substrate;
   (b) a porous polyurethane foam layer foamed in-situ and containing from between 10% and 50% by weight of its resin content a particulate filler selected from the group consisting of pulverized cellulose pulp, glass microballoons, zeolite or zeoclite, said foam layer being laminated to said substrate by compatible polymeric adhesive; and
   (c) a top coating of polyurethane elastomer bonded in surface to surface contact to said foam layer, said foam layer functioning as a cushion to prevent uneven reduction in the thickness of said top coating when the laminate is folded or stretched.

2. A polyurethane-split layer laminate according to claim 1 wherein said filler has an average particle size of between 15 and 80 microns and a bulk density between 0.1 and 0.5 g./ml.

* * * * *